US005221567A

United States Patent [19]

Baker

[11] Patent Number: 5,221,567

[45] Date of Patent: Jun. 22, 1993

[54] PACKAGING SYSTEM

[76] Inventor: Tony D. Baker, 5808 Ogilby Dr., Hudson, Ohio 44236

[21] Appl. No.: 551,068

[22] Filed: Jul. 11, 1990

[51] Int. Cl.[5] ..... B31B 1/64; B31B 1/62; B31B 49/04

[52] U.S. Cl. ..... 428/43; 493/189; 493/920; 493/194

[58] Field of Search ..... 428/43; 206/554; 383/37; 493/186, 189, 203, 917, 920, 931, 194, 195, 196, 197, 198

[56] References Cited

U.S. PATENT DOCUMENTS

| | | | |
|---|---|---|---|
| Re. 33,173 | 2/1990 | Cassey | 493/920 X |
| 3,548,723 | 12/1970 | Sengewald | 493/194 |
| 3,622,421 | 11/1971 | Cook | 493/194 X |
| 4,164,170 | 8/1979 | Nordin | 493/194 |
| 4,256,526 | 3/1981 | McDaniel | 493/189 X |
| 4,543,082 | 9/1985 | Stenner | 493/920 X |
| 4,630,310 | 12/1986 | Winesett | 493/194 X |
| 4,726,970 | 2/1988 | Morrish et al. | 428/43 X |

*Primary Examiner*—George F. Lesmes
*Assistant Examiner*—D. R. Zirker
*Attorney, Agent, or Firm*—Renner, Kenner, Greive, Bobak, Taylor & Weber

[57] ABSTRACT

A web of packaging material includes a pair of flaps folded onto a backing sheet and laterally heat sealed at uniform positions along the web, forming pairs of bags having laterally opposed openings. The web is perforated at the heat seals to allow ease of separation of the pairs of bags from the web, while longitudinal perforations allow for the separation of the bags of each pair from each other. Releasable adhesive strips are provided on closure flaps to allow closure of the openings of the separated bags. The bags are filled by draping them over a carrier bar, passing them under a blower and filler, and subsequently separating the bag pairs from each other and sealing them.

19 Claims, 2 Drawing Sheets

PACKAGING SYSTEM

TECHNICAL FIELD

The invention herein resides in the art of packaging systems and, more particularly, to packaging systems involving envelopes or pockets which are filled with articles and sealed. Specifically, the invention relates to the structure, development, and implementation of a web of such envelopes or pockets.

BACKGROUND ART

It is well known that many industries require the packaging of a selected number of articles into an envelope which is subsequently sealed and distributed to an end user. Previous packaging systems have employed a web or loop of serially aligned bags which are fed to a loading machine where the bags are filled, sealed, and separated from the web in a singular serial fashion.

Employing these prior art structures and techniques, the singular filling of individual bags has seriously limited the efficiency and speed of the packaging operation. The previously known bags have also been typically limited as to the width of the bag, such bags generally requiring an opening exceeding two inches. Further, the prior art has been devoid of bags employing other than a heat seal, such seals necessarily being destroyed upon opening of the bag, not allowing for reuse thereof.

There is presently a need in the art for a packaging system in which plural bags can be filled at the same time, and in which the bags, envelopes or pockets are not serially aligned in a web, but arranged in a matrix. There is further a need in the art for packaging systems in which plural bags can be simultaneously loaded, and in which the seals of the bags are adapted for reuse. It is further desirable to provide a packaging system capable of handling bags of various dimensions.

DISCLOSURE OF INVENTION

In light of the foregoing, it is a first aspect of the invention to provide a packaging system in which the envelopes of the web are arranged in a matrix.

Another aspect of the invention is the provision of a packaging system in which plural bags can be simultaneously loaded.

Still a further aspect of the invention is the provision of a packaging system in which resealable bags are employed.

Yet another aspect of the invention is the provision of a packaging system in which bags of various dimensions can be employed.

Still a further aspect of the invention is the provision of packaging system which may be employed with state of the art techniques and apparatus.

The foregoing and other aspects of the invention which will become apparent herein are attained by packaging material, comprising: a web of material having lateral portions thereof folded onto itself, forming first and second flaps received upon a backing sheet, said first and second flaps having respective first edges connected to said backing sheet and second edges opposite each other and exposing said backing sheet therebetween; and sealing means laterally traversing said web of material at intervals along the length thereof for sealing said first and second flaps to said backing sheet at said intervals and defining envelopes therebetween.

Other aspects of the invention which will become apparent herein are attained by a web of packaging material, comprising: a sheet have first and second lateral edges; a first flap attached to said sheet at said first lateral edge; a second flap attached to said sheet at said second lateral edge, said first and second flaps extending toward each other over said sheet; and a plurality of seals laterally traversing said sheet and said first and second flaps at spaced apart locations and securing said flaps to said sheets at such locations, defining a plurality of pockets.

Yet other aspects of the invention are attained by apparatus for loading packages with items, comprising: a web of longitudinally extending pairs of pockets, said pockets having openings therein, said pockets of each pair having said openings thereof laterally aligned with each other and opposite each other; first means for receiving said web and separating pairs of pockets therefrom; second means operatively connected to said first means for receiving and opening said pairs of pockets; and third means operatively connected to said second means for receiving said opened pairs of pockets and loading said items thereinto.

DESCRIPTION OF DRAWINGS

For a complete understanding of the objects, techniques and structure of the invention reference should be made to the following detailed description and accompanying drawings wherein.

BEST MODE FOR CARRYING OUT THE INVENTION

Figure 1:
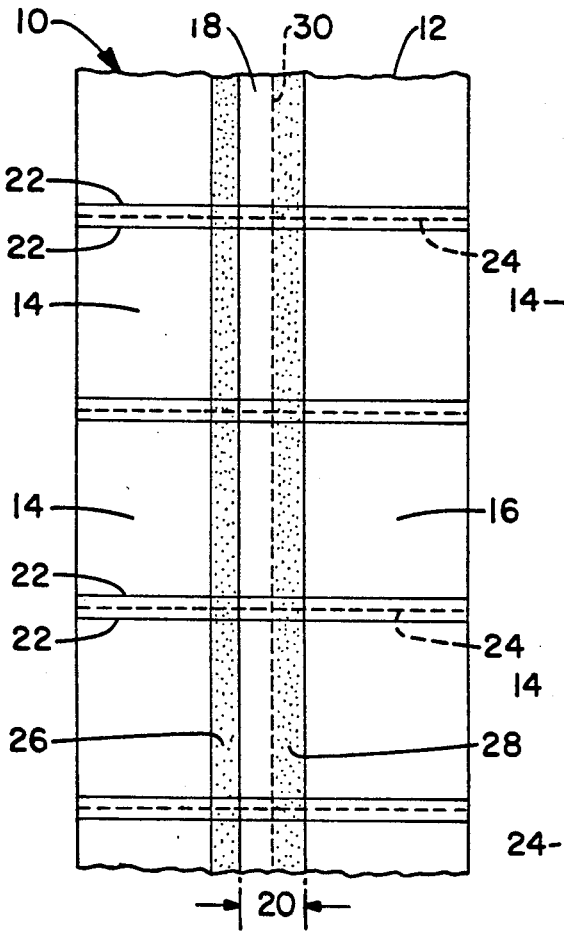
FIG. 1 is a partial sectional view of a web of packaging material according to a first embodiment of the invention.

Referring now to the drawings and more particularly FIG. 1, it can be seen that a web of packaging material according to the invention is designated generally by the numeral 10. The web 10 comprises a single sheet of suitable stock such as plastic film, paper, or the like which may be employed for the formation and implementation of bags, envelopes and the like. The opposite lateral edges of the sheet 12 are folded onto the sheet to form a pair of opposed flaps 14, 16. Accordingly, the web 10 comprises a backing layer or sheet 18 having a pair of opposed flaps 14, 16 laid thereover. The flaps 14, 16 are spaced apart by a suitable distance such as the distance 20. Accordingly, in the areas of the flaps 14, 16 the web 10 constitutes a double layer, while in the area 20, only the backing layer 18 is present.

The backing layer 18 and the opposed flaps 14, 16 are employed to form a matrix of envelopes or bags from the web 10. Pairs of heat seals 22 are formed laterally across the web 10 at spaced locations therealong. In a preferred embodiment of the invention, the spacing between the pairs of heat seals 22 are uniform. The heat seals 22 seal the flaps 14, 16 to the backing sheet 18 therealong. Accordingly, the areas of the web 10 between adjacent pairs of heat seals 22 comprise a pair of laterally opposed bags having the open ends thereof separated by the area 20.

To provide for the separation of the laterally opposed pairs of bags, the web 10 is perforated as at 24 between the two heat seals comprising each of the heat seal pairs 22. The perforation 24 provides for ease of tearing one pair of bags from the adjacent pair.

A strip of releasable adhesive 26 may be provided parallel to and in juxtaposition with the open edge of each of the flaps 14, 16. In FIG. 1, such an adhesive strip 26 is shown only in association with the flap 14, but it will be appreciated that a similar strip could be provided parallel to and in juxtaposition with the open edge of the flap 16. In another embodiment of the invention, a strip of releasable adhesive 28 may be applied to the backing sheet 18 within the area 20 and in juxtaposition to the open edges of the flaps 14, 16. While only one adhesive strip 28 is shown in FIG. 1, the same being presented in association with the flap 16, it will be appreciated that a second such adhesive strip could be provided within the area 20 and upon the backing sheet 18 in association with the flap 14. In the preferred embodiment of the invention, the adhesive employed in the strips 26, 28 is not only releasable and therefore reusable, but is also of the low residue type.

Longitudinal perforations 30 are provided along the center line of the web 10 through the backing sheet or layer 18. As will be appreciated by those skilled in the art, the perforations 30 allow for ease of separation of the pairs of bags defined between the perforations 24. Accordingly, the perforations 24, 30 allow for the matrix of bags upon the web 10 to be separated from each other. It will, of course, be appreciated that if adhesive strips 28 are provided on the backing sheet 18, the perforations 30 would extend between such strips and parallel thereto.

It should now be readily appreciated that the bags formed between the perforations 24, 30 also include flaps for closure purposes, the same having a width substantially half that of the area 20. The bags are carried upon the web 10 two abreast, having openings which are laterally opposed to each other and directed toward the center of the web as identified by the perforations 30. The bags are heat sealed at the edges thereof as at 22, and closed along the lateral edges thereof by the fold of the sheet 12 forming the flaps 14, 16 and backing sheet 18. Individual bags are readily formed by tearing at the perforation 24, 30, with such individual bags having either an adhesive strip 26 on the front of the bag, or an adhesive strip 28 on the top cover flap thereof.

Figure 2:
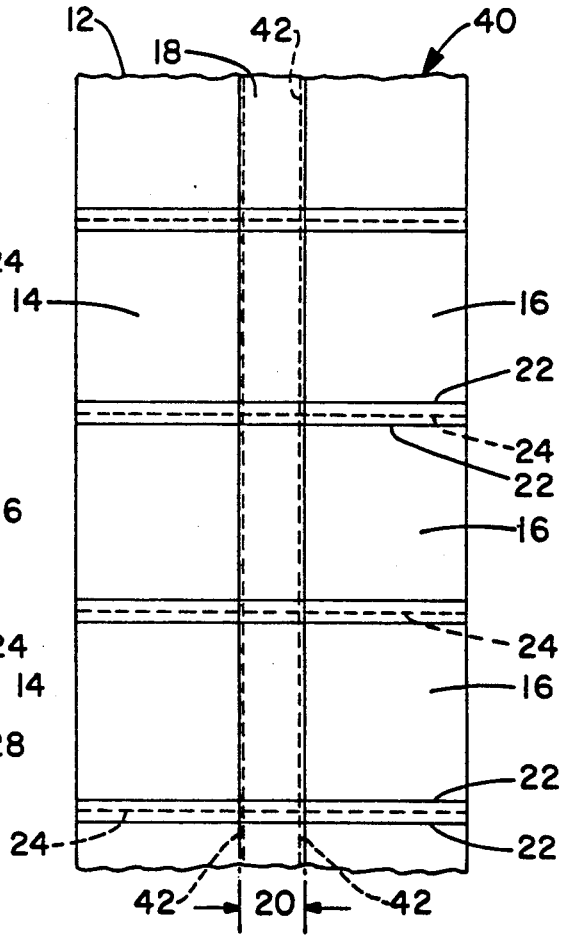
FIG. 2 is a partial sectional view of packaging material according to a second embodiment of the invention.

Another embodiment of the invention is shown in FIG. 2, in which the web is designated generally by the numeral 40. Here, a single sheet 12 is used to form a web having side flaps 14, 16 folded over the backing sheet 18, in similar fashion to the structure of FIG. 1. Lateral heat seal pairs 22 with interposed lateral perforations 24 are also provided. According to this invention, however, a pair of longitudinal perforations 42 are presented along each edge of the area 20 of the backing sheet 18, in juxtaposition to or substantial alignment with the open edges of the flaps 14, 16. Again, a matrix of bags, presented in pairs having laterally opposed openings is provided. However, the bags of this embodiment are adapted to be closed by heat sealing, rather than the removable adhesive strip of FIG. 1. Accordingly, no top flap is provided, but the bags are simply separated from each other at the tops thereof by means of the parallel longitudinal perforations 42. It should be appreciated with respect to FIG. 2 that the bags thereof are substantially identical to those of FIG. 1, but for the method of finally sealing the tops thereof.

It should be appreciated by those skilled in the art that various modifications may be made to the webs 10, 40 to accommodate the intended utility of the packaging bags presented thereby. For example, the perforations 42 could be eliminated in systems where opposed bags are separated from each other by a razor slitter or the like. Similarly, the area 20 could be provided with pairs of holes between opposed bag pairs if it is intended for the bags to serve as hang or "wicket" bags.

Figure 3:
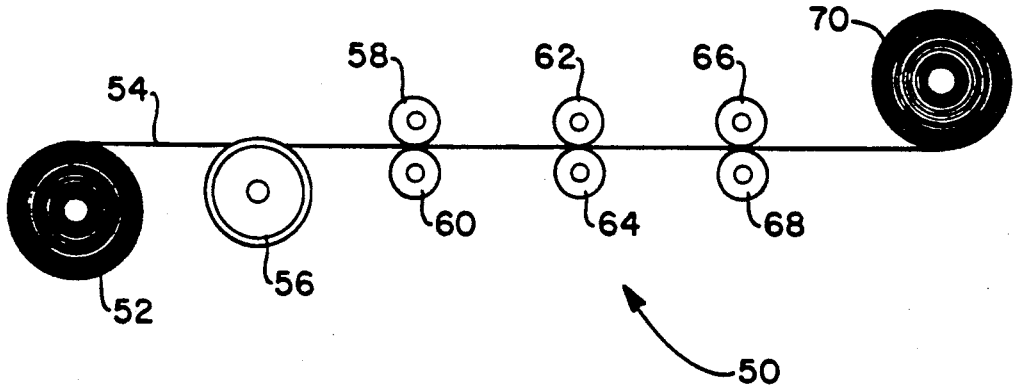
FIG. 3 is a schematic illustration of apparatus for making the packaging material web of FIGS. 1 and 2.

Referring now to FIG. 3, it can be seen that an apparatus for performing the manufacturing process of the webs 10, 40 is designated generally by the numeral 50. Here, a bulk roll of packaging material such as plastic, paper, or the like is designated generally by the numeral 52. A web 54 is drawn from the roll 52 and passed to a folding wheel 56 in which the flaps 14, 16 are folded onto the backing sheet portion 18 of the sheet 12. It will be appreciated by those skilled in the art that the web 54 could, in fact, comprise a continuous cylindrical or tubular sleeve, in which case the flap and backing sheet arrangement 14, 16, 18 of FIGS. 1 and 2 could readily be attained by simply removing the portion 20 along the sleeve, such removal being easily attained by a slitter knife or the like which would replace the folding wheel 56.

In any event, the web leaving the wheel 56 comprises a pair of flap 14, 16 lying upon a backing sheet 18. This web enters the bite between a heat seal roll 58 and a backup roll 60, the heat seal roll 58 imparting the transverse pairs of parallel heat seals 22 across the web, sealing the flaps 14, 16 to the backing sheet 18 at longitudinally spaced positions.

A perforating wheel 62, acting against a back-up or anvil roll 64 then receives the web, generating the transverse perforations 24 therein and, dependent upon whether the web 10 or 40 is to be generated, introducing the longitudinal perforations 30 or 42.

With the perforation of the web completed, if the web 10 of the embodiment of FIG. 1 is to be generated, the web is then passed to an adhesive applying roll 66, acting against a back-up roll 68, the same being used in standard fashion to apply either the adhesive strips 26 to the flaps 14, 16, or the adhesive strips 28 on either side of the perforations 30. Obviously, if the web 40 of FIG. 2 is to be manufactured, the elements 66, 68 are not employed. In either event, the finished web is then passed to a take-up roll or spool 70, which then contains a roll of the packaging webs 10 or 40.

Figure 4:
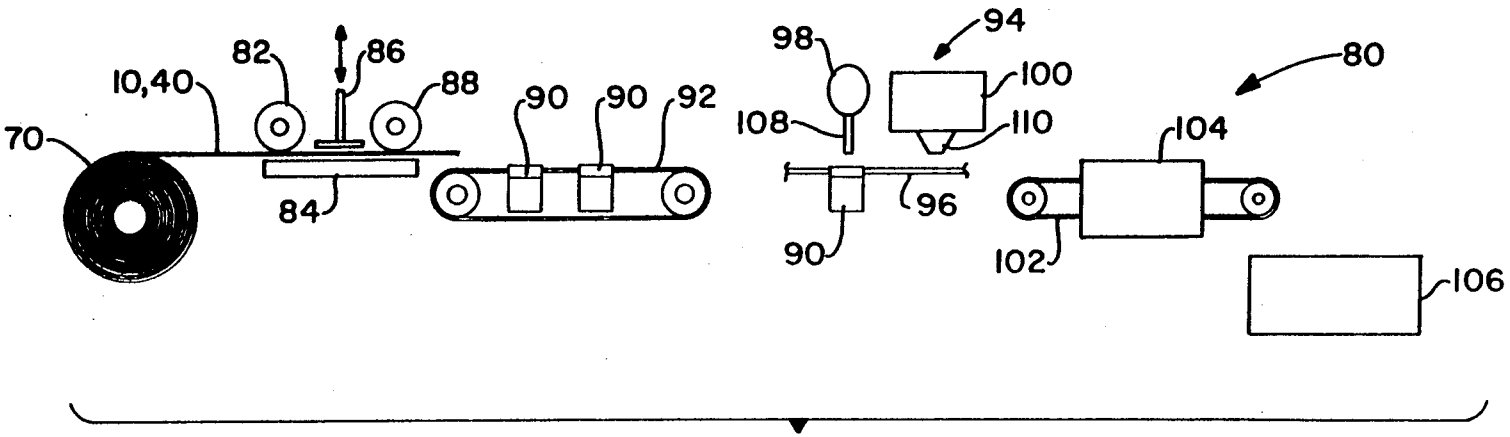
FIG. 4 is a schematic diagram of a system employing the packaging webs of FIGS. 1 and 2 to fill the bags or pockets thereof with articles.

With reference now to FIG. 4, a packaging system for employing the webs 10 or 40 in a filling machine environment is shown as designated generally by the numeral 80. The bulk roll of the web 70, taken from the apparatus of FIG. 3, provides a web 10, 40 through a drive roll 82 which operates against an appropriate table or back-up roll 84, as the case may be. The web 10, 40 is moved across the table 84 and under a brake 86 which is operated to intermittently stop the longitudinal movement of the web such that a tearing wheel 88 may engage the leading edge of the web and pull therefrom the leading pair of laterally opposed bags by tearing the perforation line 24 separating them. The pairs of bags 90 are then deposited onto a suitable conveyor belt or system 92, the area 20 of the backing sheet 18 being received by the belt or conveyor system such that the bags of the pair of bags hang on opposite sides of the conveyor itself.

Figure 6:
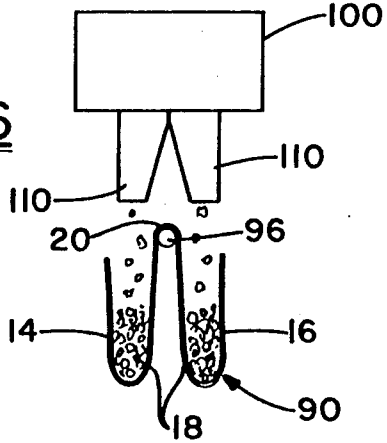
FIG. 6 is an end view of the loading section of the apparatus of FIG. 4.
Figure 5:
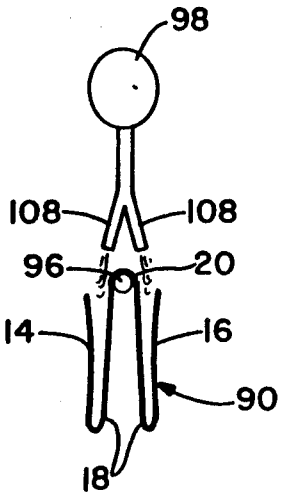
FIG. 5 is an end view of the blower section of the structure of FIG. 4.

The pairs of bags 90 are conveyed to a filling station 94 at which a reciprocating bar or indexing wheel 96 receives the pairs of bags 90. The bar or indexing wheel 96 moves the bags past a blower 98 which, as shown in FIG. 5, includes a double air injector 108 blowing air into the bags defined between the flaps 14, 16 and the backing sheet 18. With the bags so opened as shown in FIG. 6, they are then transported by the bar or wheel 96 to the filler 100 having a pair of chutes 110 which then deposit a pre-counted and/or sorted array of items or articles into the bags between the flaps 14, 16 and backing sheet 18.

The filled pair of bags 90 is then transported by the reciprocating bar or wheel 96 to an appropriate conveyor 102 operating in conjunction with sealer 104. As will be appreciated by those skilled in the art, if the web 10 of FIG. 1 is employed, the sealer 104 separates the pair of bags 90 at the perforation 30 as by the employment of opposed rotating wheels or the like. The top flap of each of the bags, formed by the material of the packing sheet 18 within the area 20, is then folded onto the front of the bag constituting either the flap 14 or 16. The appropriate adhesive strips 26 or 28 then conclude the sealing function, and the closed bags are then deposited into the receptacle 106.

If the web 40 is employed in the structure of FIG. 4, then the sealer 104 simply comprises a heat seal which seals the top open edge of the flaps 14, 16 against the backing sheet 18. The bags may then be separated from each other by simply tearing the two perforations 42 or by employing a razor slitter in the absence of such perforations. Again, opposed rotating wheels and standard heat sealing equipment may be employed. It also may be desired that the bags be stripped from each other before heat sealing, or afterwards.

Thus it can be seen that the objects of the invention have been satisfied by the structure presented above. A plurality of bags may be simultaneously filled using the structure of the invention and, since the openings of the bags are along the longitudinal axis of the web, rather than traversing the web, smaller bags may be used than previously available in the art. Additionally, reusable seals may be employed. Numerous benefits of the invention will be readily apparent to those skilled in the art. Similarly, modifications of the concepts of the invention will also be readily apparent. Accordingly, for an appreciation of the true scope and breadth of the invention reference should be made to the following claims.

What is claimed is:

1. Packaging material, comprising:

a web of material having lateral portions thereof onto itself, forming first and second flaps received upon a backing sheet, said first and second flaps having respective first edges connected to said backing sheet and second edges opposite each other and exposing said backing sheet therebetween; and a plurality of sealing means, each laterally traversing said web of material, said sealing means being positioned at intervals along the length thereof for sealing said first and second flaps to said backing sheet at said intervals and defining envelopes therebetween, said envelopes being formed in aligned pairs, each of said envelopes having an opening, said openings of said aligned pairs of envelopes being laterally opposed and aligned.

2. The packaging material according to claim 1, further comprising first separation means longitudinally traversing said sheet of material between said second edges of said flaps for separating said backing sheet into two parts, a first part carrying said first flap, and a second part carrying said second flap.

3. The packaging material according to claim 2, further comprising second separation means, laterally transversing said web in juxtaposition to said sealing means, for separating said envelopes from each other along lateral edges thereof, said first and second separation means separating each envelope from all other envelopes in said web.

4. The packaging material according to claim 3, wherein said sealing means comprises pairs of parallel seal strips interconnecting said first and second flaps to said backing sheet, one of said pairs being at each said interval.

5. The packaging material according to claim 4, wherein said second separation means extends between said pairs of parallel seal strips.

6. The packaging material according to claim 5, wherein said first and second separation means comprise perforations passing through said web.

7. The packaging material according to claim 6, wherein said first separation means comprises a pair of perforation lines, one perforation line associated with each of said flaps.

8. The packaging material according to claim 7, wherein each of said perforation lines of said pair of perforation lines is substantially aligned with said second edge of said associated flap.

9. The packaging material according to claim 6, wherein said first separation means comprises a perforation line extending along said backing sheet in said exposed area at a center portion thereof.

10. The packaging material according to claim 9, further comprising an adhesive strip on each side of said perforation line on said exposed area.

11. The packaging material according to claim 9, further comprising an adhesive strip along each of said first and second flaps at said second edges.

12. A web of packaging material, comprising:

a sheet having first and second lateral edges;

a first flap attached to said sheet at said first lateral edge;

a second flap attached to said sheet at said second lateral edge, said first and second flaps extending toward each other over said sheet; and a plurality of seals, each seal laterally traversing said sheet and said first and second flaps, said seals positioned at spaced apart locations and securing said flaps to said sheet at such locations, defining a plurality of pockets, wherein said pockets are formed as a linear arrangement of aligned pairs, each of said pockets of each of said aligned pairs having an opening, said openings of said aligned pairs being laterally opposed.

13. The web of packaging material according to claim 12, further comprising a first longitudinal perforation extending through said sheet between said first and second flaps.

14. The web of packaging material according to claim 13, further comprising a lateral perforation traversing said sheet and first and second flaps at each of said seals.

15. The web of packaging material according to claim 14, further comprising an adhesive strip longitudinally extending along said sheet on each side of said first longitudinal perforation.

16. The web of packaging material according to claim 14, further comprising an adhesive strip longitudinally extending along each of said first and second flaps adjacent said openings.

17. The web of packaging material according to claim 14, further comprising a second longitudinal perforation extending through said sheet between said first and second flaps, said second longitudinal perforation being substantially parallel to said first longitudinal perforation.

18. The web of packaging material according to claim 14, wherein each of said seals comprises a pair of parallel strips of attachment between said sheet and said first and second flaps, said lateral perforation extending between said pair of parallel strips.

19. The web of packaging material according to claim 14, wherein said sheet and flaps are of plastic film material and said seals comprise heat seals.

* * * * *